US006285026B1

(12) United States Patent
Evans et al.

(10) Patent No.: US 6,285,026 B1
(45) Date of Patent: Sep. 4, 2001

(54) BOREHOLE CALIPER DERIVED FROM NEUTRON POROSITY MEASUREMENTS

(75) Inventors: Michael L. Evans, Missouri City; David L. Best, Houston, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/281,403

(22) Filed: Mar. 30, 1999

(51) Int. Cl.[7] ..... G01V 5/10
(52) U.S. Cl. ..... 250/269.4; 250/265; 250/269.1
(58) Field of Search ..... 250/269.4, 269.5, 250/265, 266; 73/152.05, 152.14

(56) References Cited

U.S. PATENT DOCUMENTS

| | | | | |
|---|---|---|---|---|
| 3,483,376 | | 12/1969 | Locke et al. . | |
| 3,662,172 | | 5/1972 | Youmans . | |
| 3,784,822 | | 1/1974 | Schuster . | |
| 4,092,536 | * | 5/1978 | Smith | 250/265 |
| 4,423,323 | | 12/1983 | Ellis et al. . | |
| 4,791,797 | | 12/1988 | Paske et al. . | |
| 5,091,644 | | 2/1992 | Minette . | |
| 5,175,429 | | 12/1992 | Hall, Jr. et al. . | |
| 5,397,893 | | 3/1995 | Minette . | |
| 5,767,510 | | 6/1998 | Evans . | |

FOREIGN PATENT DOCUMENTS

| | | |
|---|---|---|
| 0 417 001 A2 | 3/1991 | (EP) . |
| 2 187 354 A | 9/1987 | (GB) . |
| 2 314 927 A | 1/1998 | (GB) . |

OTHER PUBLICATIONS

Search Report Under Section 17, Jul. 27, 2000.

Combined Search and Examination Report Under Sections 17 & 18 (3), Jul. 31, 2000.

* cited by examiner

*Primary Examiner*—Constantine Hannaher
*Assistant Examiner*—Albert Gagliardi
(74) *Attorney, Agent, or Firm*—Victor H. Segura

(57) ABSTRACT

A system for measuring the size of a borehole penetrating an earth formation is disclosed. The system uses a neutron source and a least one neutron detector. The neutron detector responds primarily to the composite hydrogen content of material within the borehole and formation upon irradiation by the neutron source. A partition response function is used to delineate the portion of the detector response resulting from borehole and from the formation. Since the detector response from the borehole can be isolated using the partition function and the hydrogen content of the borehole fluid is generally known, the size of the borehole can be determined from borehole response portion of the composite detector response if combined with a neutron porosity measurement of the formation. The neutron porosity measurement can be obtained independently, or by combining the neutron detector response with the response of a second neutron detector at a different axial spacing from the neutron source. The system is applicable in both logging-while-drilling and wireline logging operations.

27 Claims, 4 Drawing Sheets

BOREHOLE CALIPER DERIVED FROM NEUTRON POROSITY MEASUREMENTS

BACKGROUND OF THE INVENTION

1. Field of the Invention

This invention is directed toward the determination of radial dimensions or "caliper" of a borehole penetrating earth formation, and more particularly directed toward determining caliper by irradiating formation with neutrons and measuring neutron flux within the borehole. The invention can be embodied to measure caliper while the borehole is being drilled, or alternately embodied to measure caliper as a wireline logging system used after borehole drilling has been completed.

2. Description of the Art

Accurate borehole caliper data is important for both the drilling of a well borehole, in the measurement of earth formation parameters penetrated by the borehole, and in completing the well after drilling.

In drilling a typical borehole for hydrocarbon production, the drill string is formed from sections or "joints" of drill pipe which are added to the drill string by threaded collars, and which is terminated by a drill bit. The drill string is rotated my means well known in the art, and the borehole is advanced by the cutting action of the drill bit. Drill bits must be periodically replaced as they become dulled by the drilling action. Bit replacement requires that the drill string be pulled or "tripped" from the borehole by sequentially removing joints of drill pipe. Borehole caliper data from successive trips in the borehole can be used to monitor wellbore conditions such as early indications of borehole washout and impending wellbore instability. Caliper information can allow a driller to take remedial actions during the drilling operation to prevent damage or catastrophic loss of the borehole, of drilling equipment, and even the loss of life of drilling personnel.

Formation parameter measurements as a function of depth, commonly referred to as formation "logging", can be made subsequent to the drilling of the borehole by instruments conveyed by wireline, or can be made while drilling the borehole by instrumentation conveyed by a drill string. These techniques are commonly referred to as "wireline logging" and "logging-while-drilling" or "LWD", respectively. Wireline and LWD measurements use borehole caliper data to correct measured parameters for various effects related to the radial dimensions of the well borehole. As examples, responses of most prior art neutron porosity, scatter gamma ray density, and resistivity type logging systems are functions of borehole size and must be corrected for borehole size effects to obtain optimum measurements of the desired formation parameters.

Once the drilling of a borehole is drilled to the desired depth, it is "completed" typically with a string of steel casing around which cement is pumped thereby filling the casing-borehole annulus. Caliper information is very useful in determining completion requirements, such as the amount of cement required to properly cement casing.

Many wireline and LWD systems are designed to minimize the effects of borehole size. The basic methodology utilizes two or more axially spaced sensors in the downhole "tool" portion of the system. Each sensor responds in a different degree to borehole size, and the responses are combined to minimize borehole effects. As an example, a dual detector neutron porosity wireline system was introduced in the 1960's in an attempt to minimize the effects of the borehole upon the measurement of formation porosity. Such a system is described in U.S. Pat. No. 3,483,376 to S. Locke issued Dec. 3, 1963. Two thermal neutron detectors are spaced axially at different distances from the source of fast neutrons. The ratio of the responses of the two detectors varies with formation porosity, yet is somewhat less sensitive to borehole parameters than the count rate from either of the two individual detectors. The ratio is, therefore, the measured parameter used to compute porosity. Corrections are made to the porosity value computed from the ratio in order to improve accuracy. Although much smaller than for single detector systems, borehole diameter corrections for dual detector systems are significant and can be quantified if an effective borehole caliper is available. More sophisticated algorithms have been used to combine sensor responses. Again using a dual detector neutron porosity system as an example, U.S. Pat. No. 4,423,323 to Darwin V. Ellis and Charles Flaum, issued Dec. 27, 1983, applies what is commonly known as the "spine and rib" interpretation to the count rate of each neutron detector in order to obtain a borehole size invariant porosity measurement without using an independent borehole caliper signal. The algorithm is relatively complex, and the range of borehole diameter variation over which reliable compensation can be obtained is relatively limited.

Various types of wireline borehole calipering devices were, and today still are, run in conjunction with borehole size sensitive wireline logs to provide a measure of borehole diameter from which borehole size corrections are computed. One type of caliper is obtained from an articulating arm of a pad type tool such as a pad mounted scattered gamma ray density tool, which was introduced commercially in the 1960's and is well known in the art. This type of caliper measures only one radial dimension, which is typically the major radial axis in a non-round borehole. Other prior art wireline calipers utilize measurements from multiple arm devices. These devices can be "stand-alone" caliper tools. Alternately, borehole caliper information can be obtained from arm positions of other types of logging tools such as multiple-arm formation dip tools. Although yielding a more representative measure of borehole size than a single arm device, multiple-arm devices are notoriously complex mechanically, difficult to operate effectively in harsh borehole conditions, difficult to maintain calibrated, and expensive to fabricate.

Prior art LWD systems, like their wireline counterparts, are sensitive to borehole size. Accurate caliper information is required to properly correct parametric measurements from these systems. It is readily apparent that arm type wireline calipers are not applicable to LWD since the drill string is typically rotating, and the arms engaging the penetrated formation would be quickly severed by this rotational movement. Other basic approaches must, therefore, be applied to LWD calipering.

Various methods have been used to obtain borehole size in LWD systems. Estimates can be obtained from the drill bit diameter, the drilling fluid pumping pressure, and the mechanical properties of the formation being penetrated. This method, at best, provides only a rough estimate of a borehole caliper in the vicinity of the drill bit since formation and drilling mechanical conditions can change rapidly. Other methods have been employed in an attempt to reliably caliper the borehole without using a specifically dedicated LWD caliper system. Generally speaking, these methods combine data from a plurality of LWD devices which exhibit different sensitivities to borehole geometric parameters. Such additional LWD devices might include well known scattered gamma ray density devices and resistivity devices which respond to varying radial depths of the borehole and formation environs. Borehole information is extracted by combining responses of these devices, and borehole corrections are derived from these responses. Again, generally speaking, this method of calipering a borehole and correcting measurements for borehole effects is not reliable. In addition, a relatively complex suite of LWD devices must be employed in order to practice this method.

U.S. Pat. No. 5,175,429 to Hugh E. Hall. Jr. et al, issued Dec. 29, 1992, addresses borehole calipering as a tool stand-off compensation method for nuclear LWD measurements. No independent borehole caliper or any other subsystem is required to obtain the desired tool stand-off or borehole size compensation. Count rates from a plurality of nuclear detectors are sorted and stored in "bins" as a function of apparent instrument stand-off. Detector responses are examined as a function of energy level thereby requiring spectral recording capabilities in the borehole instrument. These required features greatly increase the complexity of the borehole instrument, increase the demands on the logging-while-drilling telemetry system, and necessitate a relatively complex interpretation algorithm.

Most prior art LWD systems dedicated specifically to borehole calipering typically employ acoustic methods. More specifically, acoustic methods have been employed in order to obtain an improved measure of the position of the borehole wall in the vicinity of neutron porosity and other LWD systems which might require a borehole size correction. The dedicated borehole acoustic caliper typically emits high frequency acoustic impulses radially from one or more transducers positioned on the periphery of the LWD instrument. These acoustic signals traverse intervening drilling fluid, are reflected at the borehole wall, and again traverse intervening drilling fluid as part of the energy returns to the LWD instrument. The time between the emission of the acoustic pulse and the detection of the reflected pulse is measured. If the acoustic properties of the drilling fluid are known, the distance to the borehole wall can be computed from the measured travel time. Compared to the previously discussed method, this is a more accurate and precise means for "calipering" the borehole. There are, however, disadvantages. The acoustic caliper methodology requires an additional LWD system which is relatively complex and which must operate in the harsh drilling environment. This decreases reliability, increases operational cost, and increases the manufacturing cost of the LWD assembly. Furthermore, any type of reliable acoustic measurement is difficult to obtain in the acoustically "noisy" drilling environment. Still further, once a radial profile of the borehole is obtained, this measurement must be processed mathematically in order to obtain a borehole correction for a specific LWD system matching radial profile to an azimuthal response factor of the system.

U.S. Pat. No. 5,767,510 to Michael L. Evans, issued Jun. 16, 1998, discloses a borehole invariant porosity system, and is hereby entered into this disclosure by reference. The system, which can be embodied as a LWD or a wireline system, is directed toward providing a borehole size invariant neutron porosity measurement using only the responses of "near" and "far" spaced detectors from a source of fast neutrons. No independent borehole caliper measurement is required. As discussed previously, the perturbing effects of borehole size, borehole shape, and the radial position of the instrument within the borehole is overcome, at least to the first order, by computing porosity from a simple ratio of the detector responses. This ratio method does not, however, provide complete borehole size compensation. Additional compensation for borehole effects is obtained by modifying the simple ratio of the near detector to far detector count rates. A function of the far detector count rate has been found that results in a near detector response and a modified far detector response which exhibits nearly identical apparent radial sensitivities over the normal operating range of the tool. The result is a "modified" ratio of near detector count rate to modified far detector count rate that varies with formation, but that is essentially insensitive to radial perturbations such as variations in borehole diameter. Although porosity measurements produced by the Evans system require no caliper for correcting porosity measurements for borehole size, the system disclosed no means for generating a caliper log from the response of the tool.

In view of the previous discussion of background, an object of the present invention is to provide a borehole caliper system which requires no articulating mechanical arms, and which can be embodied as a LWD and a wireline system. A further object of the present invention is to provide a caliper measurement which can be obtained from the responses of one or more sensors deployed in LWD or wireline logging systems and used to make other measurements of properties of formations penetrated by a borehole. Yet another object of the invention is to utilize the response of neutron detectors in a dual detector neutron porosity system to simultaneously generate a formation porosity measurement, corrected for borehole size, and subsequently use the corrected formation porosity in obtaining a borehole caliper log.

Another advantage of the present invention is to provide a borehole caliper log from the response of one detector of a neutron porosity system combined with formation porosity independently measured with another type of LWD or wireline system which measures the neutron porosity of the formation. Still another benefit of the present invention is to provide a borehole caliper log from a detector responsive to hydrogen index combined with an independent measure of formation porosity. There are other objects and applications of the present invention that will become apparent in the following disclosure.

SUMMARY OF THE INVENTION

The present invention is directed toward providing a caliper log of a borehole penetrating a formation by combining the response of a single downhole sensor and a knowledge of true formation porosity.

In discussing the background of this invention, a dual detector neutron porosity logging system is used in several illustrative examples. The downhole "tool" portion of the system, which can be conveyed by wireline or drill string, consists typically of a source of fast neutrons and one or more neutron detectors. Neutrons emitted by the source interact with nuclei within the formation and borehole fluid, with a portion of these neutrons returning to the borehole and impinging upon the one or more detectors.

Neutron detector response is a function of the degree to which the formation and borehole fluid slow down or moderate fast neutrons emitted by the source. Moderation is inversely proportional to the atomic mass of the nuclei with which the neutron reacts. The measure of neutron porosity is, therefore, governed chiefly by the concentration of hydrogen, or the "hydrogen index", of fluid within the borehole and in the formation surrounding the downhole neutron porosity tool. The relative influence of the formation and borehole regions upon the response of a detector depends mostly upon the axial spacing of the detector from the source, but is fixed with a chosen tool design. Hydrogen index is often referred to as "HI". The relative detector response to the borehole and formation regions, or response "partition", is determined by a series of experiments in which the borehole diameter is varied with all other borehole and formation conditions held fixed. If the hydrogen index of the formation region is determined independently, the detector response can be combined with the response partition to determine detector response from the borehole region, which is a function of the hydrogen index of the borehole fluid and the size of the borehole. The borehole fluid is typically drilling "mud" of known constituents, or water of known salinity, therefore the hydrogen index of the borehole fluid is typically known or easily measured. Known borehole fluid hydrogen index is then combined with detector response attributable to the borehole region to yield a measure of borehole size or caliper.

Apparatus usually comprises a single downhole sensor which responds to hydrogen index, and for which the formation-borehole partition function is known. The required independent determination of "true" formation porosity can be obtained from any type of logging system from which the neutron porosity of the formation can be obtained.

The previously referenced neutron porosity system disclosed in U.S. Pat. No. 5,767,510 to Evans is particularly suited for adaptation to the present invention. This system incorporates a source of fast neutrons, and near and far neutron detectors axially spaced from the neutron source. Compensation for borehole effects is greatly improved by modifying the simple ratio of near detector to far detector responses. The result is a "modified" ratio of near detector count rate to modified far detector count rate that varies with formation, but that is essentially insensitive to variations in borehole diameter. True formation porosity is computed from this modified ratio without the need of caliper information. A formation-borehole partition function is then determined for one of the detectors, and preferably for the near detector since it is more responsive to the borehole fluid. Near detector count rate is then combined with the partition function, true formation porosity obtained from the modified ratio, and an a prior knowledge of borehole fluid hydrogen index to obtain a measure of the borehole size.

The present invention can be embodied as a wireline logging system, or as a LWD system. The neutron source is preferably a isotopic or "chemical" type source which emits a continuous flux of neutrons. Alternate sources of neutrons include accelerator type neutron sources operating in a steady state mode, or accelerator type neutron sources operating in a pulsed mode wherein neutron detector response is time averaged over a relative large number of pulse cycles.

The invention is directed toward measuring the size of a borehole penetrating earth formation. It should be understood, however, that the invention can also be used to be measure the size of any type of borehole penetrating any type of material if (a) the borehole contains a hydrogenous fluid and (b) the neutron porosity of the material is known. If the material contains hydrogen only in pore spaces, any type of material porosity measurement yielding fractional or percent pore space can be used in the borehole size determination. Any chemically bound hydrogen in the material, as found in clays as an example, necessitates the use of a neutron porosity measurement of the material in order to obtain an accurate borehole size measurement.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention nay admit to other equally effective embodiments.

DESCRIPTION OF THE PREFERRED EMBODIMENTS

Figure 1:
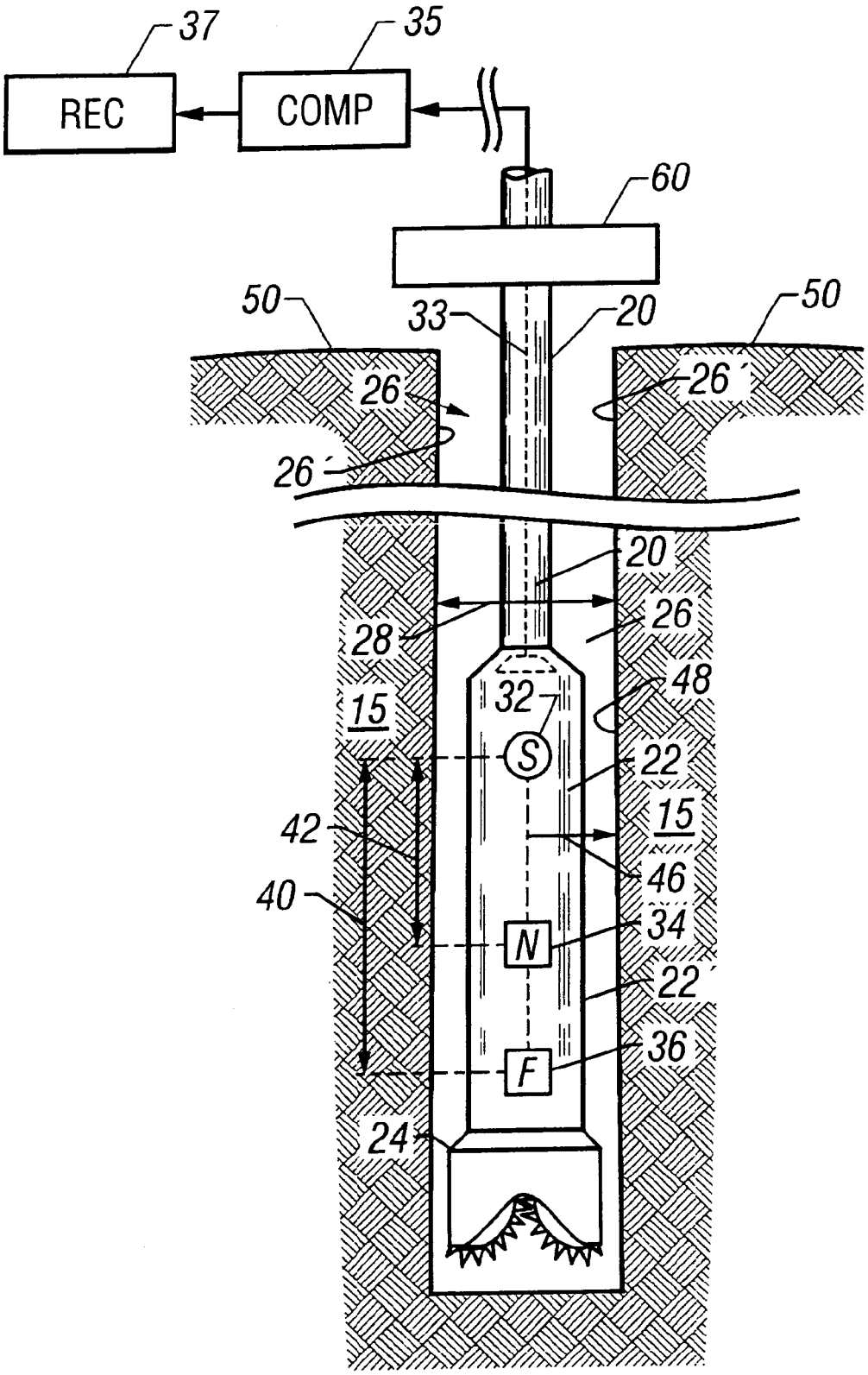
FIG. 1 is a conceptual illustration of a borehole caliper system configured as a dual detector neutron porosity system and embodied as a LWD borehole tool.

The disclosure of preferred embodiments is divided into five sections. The first section presents mathematical formalism used to disclose the basic concepts of the invention, the second section is devoted to apparatus required to embody the invention, and the third section summarizes data processing methods. The fourth section illustrates results obtained with the invention, and the fifth section is devoted to alternate embodiments of the invention.

1. MATHEMATICAL FORMALISM

As mentioned previously, computation of borehole size requires a knowledge of true formation neutron porosity. Although formation neutron porosity can be obtained from numerous sources, the previously referenced dual detector, borehole invariant system of Evans is ideally suited for combination with the present invention. As a brief review of the disclosure of Evans, porosity is computed from the relationship $$Ø=f(R) \tag{1}$$

where:

$$R=N_S(Ø)/F_S(Ø) \tag{2}$$

and where:

Ø=porosity in porosity units (p.u.);

f(R)=a ratio-to-porosity transform function;

$N_S(Ø)$=near detector count rate for a "standard" formation of porosity Ø with standard borehole conditions; and $F_S(Ø)$=far detector count rate for a "standard" formation of porosity Ø with standard borehole conditions.

Physically, the quantity R is the simple ratio of near detector count rate to far detector count rate in "standard" borehole and formation conditions as discussed in the Evans disclosure. The functional relationship between the detector ratio R and porosity Ø, as defined in equation (1), is determined by either mathematically modeling the response of the tool under standard formation and borehole conditions, or by measuring the response under standard formation and borehole conditions, or by combining mathematical modeling with measurements.

All boreholes in which the porosity device is to operate are certainly not "standard". Non-standard borehole conditions, or a combination of non-standard borehole conditions and non-standard formation conditions, vary both the near and the far count rates. For the moment, only non-standard borehole conditions will be considered and can be expressed as $$N(Ø)=N_S(Ø)a(d,ms,mw) \tag{3}$$

and $$F(Ø)=F_S(Ø)b(d,ms,mw) \tag{4}$$

where:

N(Ø)=the near detector count rate for non-standard boreholes;

F(Ø)=the far detector count rate for non-standard boreholes; a(d,ms,mw)=a function relating near detector count rate in standard and non-standard boreholes;

b(d,ms,mw)=a function relating far detector count rate in standard and non-standard boreholes;

d=the diameter of the borehole in inches (in.);

ms=the salinity of the drilling fluid in parts per million NaCl (ppm NaCl); and mw=the weight of the drilling fluid in pounds per gallon (lb/gal).

Substituting equations (3) and (4) into equation (2) yields $$R=N(Ø)/(F(Ø)^X(d,ms,mw)) \tag{5}$$

where $$X(d,ms,mw)=a(d,ms,mw)/b(d,ms,mw). \tag{6}$$

It should be understood that the above parameters can be expressed in other units, such as the borehole diameter d can be expressed in millimeters or centimeters. Physically, the ratio of near detector to far detector count rate expressed in equation (5) is the modified count rate ratio previously discussed. More specifically, raising the denominator (far count rate) to the X(d,ms,mw) power effectively "normalizes" the near/far ratio measured in non-standard conditions to the corresponding ratio that would have been obtained in standard borehole conditions. This modified or normalized ratio, when used in the function of equation (1), then yields porosity values Ø which have been corrected for non-standard borehole conditions. It has been found that the modified ratio of equation (5) is invariant to borehole size for boreholes ranging from about 8 inches in diameter to about 12 inches in diameter. Porosity values computed using this ratio and the function defined in equation (1) will, therefore, be automatically corrected for borehole size.

Porosity values computed from the modified near/far ratio of equation (5) are the borehole invariant porosity (BIP) values, or more precisely, the borehole size invariant porosity values, discussed previously. It should be noted that X, and therefore R and the corresponding values of Ø, are still functions of drilling fluid salinity (ms) and drilling fluid weight (mw). These quantities can usually be estimated with sufficient accuracy, knowing materials added to the drilling fluid during the drilling, such that significant errors are not induced into the porosity calculations. Alternately, various MWD and LWD systems are disclosed in the prior art which measure drilling fluid salinity and drilling fluid weight in the immediate vicinity of the downhole assembly.

Methods for correcting porosity values Ø for the effects of non-standard lithologies, such as sandstone or dolomite, are well known in the art. Methods for correcting porosity values Ø for the effects of "non-standard" formation fluids, such as saline water, are also well known in the art. The formation porosity $Ø_{true}$ is obtained by correction Ø for non standard conditions and will be expressed by the general function $$Ø_{true}=KØ, \tag{7}$$

where K represents all non-standard "environmental" corrections.

Porosity can be determined from the count rate of either the near or the far detector if a transform for count rate to porosity has been developed for known borehole and formation conditions. Most all borehole fluids contain a large concentration of hydrogen. Typical examples of borehole fluids are drilling liquids with fresh water, salt water, or oil base. The amount of borehole fluid in the vicinity of the caliper tool is a function of the borehole size. A measure of the amount of borehole fluid can therefore be related to borehole caliper. Since the present invention yields a caliper log based upon the measure of the hydrogen index of the borehole fluid, it is advantageous to compute a porosity $Ø_{near}$ from the response of the near detector, since this detector is more sensitive to borehole material due to its closer proximity to the neutron source. The difference between $Ø_{true}$ and $Ø_{near}$ can be expressed as $$Ø_{near}-Ø_{true}=a_1(d-a_2)(1+a_3(Ø_{true}-a_4)^2) \tag{8}$$

where $a_1$, $a_2$, $a_3$ and $a_4$ are coefficients determined by fitting equation (8) to a response data base for the tool, and d is again the effective diameter of the borehole in which the response data were measured.

The porosity response of the near spaced detector, $Ø_{near}$, can be parameterized by fitting the measured, near spaced detector count rate $CR_{near}$ in known borehole and formation conditions yielding $$CR_{near}=b_1(Ø_{near}+b_2)^{b_3}+b_4. \tag{9}$$

Solving equation (9) for $Ø_{near}$ yields $$Ø_{near}=((CR_{near}-b_4)/b_1)^{(1/b_3)}-b_2. \tag{10}$$

$CR_{near}$ is measured, $Ø_{true}$ is obtained from measured quantities using equation (7) or by other true neutron porosity measuring means, and the constants $a_1$, $a_2$, $a_3$, $a_4$, $b_1$, $b_2$, $b_3$ and $b_4$ are determined by parameterizing tool response in known formation and borehole conditions, by mathematically modeling tool response in known borehole and formation conditions, or by using a combination of both methods. Equations (8) and (10) can then be combined and solved for the borehole size d thereby yielding a measure of borehole caliper which can be displayed in log form as a function of depth within the borehole at which it is determined.

2. APPARATUS

FIG. 1 illustrates a borehole caliper system configured as a dual detector neutron porosity device embodied for LWD operations. A source 32 of fast neutrons, and a near detector 34 and a far detector 36, are positioned within a drill collar 22 which will be referred to as the LWD tool. The LWD tool 22 is suspended by means of a drill string 20 within a borehole 26, defined by a borehole wall 26', and which penetrates an earth formation 15. The upper end of the drill string 20 is suspended at the surface of the earth 50 preferably from conventional rotary drilling draw works (not shown). The LWD tool 22 is conveyed along the borehole 26 by raising and lowering the drill string 20 using the draw works. A drill bit 24 is affixed to the lower end of the LWD tool 22. The drill string 20 is rotated by means of a rotary table 60 thereby rotating the LWD tool 22 and drill bit 24, and thereby extending the borehole 26 downwardly as a result of the cutting action of the drill bit 24.

A preferably conventional drilling fluid system is employed to remove cuttings formed by the rotating drill bit 24, to lubricate and cool the drill string and drill bit, and to maintain hydrostatic pressure within the borehole 26. The drilling fluid, which is typically a liquid containing a relatively large concentration of hydrogen, is pumped from the surface 50 downwardly through the drill string 20, emerges through orifices in the drill bit 24, and returns to the surface through a borehole-tool annulus defined by the known outside diameter 22' of the tool 22 and the wall 26' of the borehole 26. The neutron caliper system responds to drilling fluid within this annulus and thereby yields a measure of borehole size as described in mathematical terms above.

Attention is now directed to elements within the LWD tool 22 as shown in FIG. 1. The near detector 34 is axially spaced a distance 42 from the neutron source 32, and the far detector 36 is axially spaced a distance 40 from the neutron source 32. Because of its closer proximity to the source, the near detector 34 is more sensitive to fluid within the borehole than the far detector 36. Near detector count rate $CR_{near}$ is therefore preferably used in the caliper measurement, although count rate from the far detector could be used as an alternate means. The neutron source 32, near detector 34 and far detector 36 are pressure sealed, preferably within the wall of the tool 22, thereby isolating these elements from the borehole environs, and also allowing for a preferably coaxial channel within the tool 22 through which the drilling fluid flows. The neutron source 32 is preferably an isotopic source which emits a continuous flux of fast neutrons. Suitable isotopic sources include a mixture of Americium and beryllium (Am-Be) or, alternately, Californium-252 ($^{252}$Cf). Alternate sources of neutrons include accelerator type neutron sources operating in a steady state mode, or accelerator type neutron sources operating in a pulsed mode wherein neutron detector response is time averaged over a relative large number of pulse cycles. The near detector 34 and the far detector 36 are preferably sensitive only to very low energy neutrons, or "thermal" or "epicadmium" neutrons. Helium-3 detectors wrapped with a layer of cadmium meet this detector criterion as is well known in the art. For obtaining a measure of $Ø_{true}$, it is preferred that the far detector 36 be more sensitive to thermal neutrons for statistical reasons, since the flux of thermal neutrons at the position of the far detector will be considerably less than the thermal neutron flux at the near detector.

The relative positions of the near detector 34 and the far detector 36 can be varied with respect to the neutron source 32. for both the caliper measurement and for the measurement of $Ø_{true}$. Referring to FIG. 1, the near and far spaced detectors can both be positioned above the neutron source at preferable axial spacings 42 and 40, respectively. Alternately, either the near or far spaced detector can be positioned above the neutron source, and the other detector can be positioned below the neutron source with caliper again preferably being determined from the response of the near detector.

Power supplies (not shown), and control and data conditioning circuitry (not shown) for the detectors 34 and 36 are contained preferably within the LWD tool 22. The counting rate $CR_{near}$ of the near detector for determining borehole size, and the counting rate of the far detector for combining with $CR_{near}$ to determine $Ø_{true}$, are preferably telemetered to the surface of the earth 50. Telemetry is preferably by means of a mud pulse telemetry system, illustrated conceptually with the broken line 33, or other suitable telemetry system known in the LWD art. Alternately, the count rate data can be recorded and stored within a memory means (not shown), preferably located within the LWD tool 22, for subsequent retrieval when the LWD tool is returned to the surface of the earth. The count rate data are converted, at the surface of the earth, to a borehole size measurement using a computer 35, and preferably displayed and recorded with a recorder 37 as a function of depth at which the count rates were recorded, thereby creating a borehole caliper log as a function of depth within the borehole 26.

3. DATA PROCESSING

Figure 2:
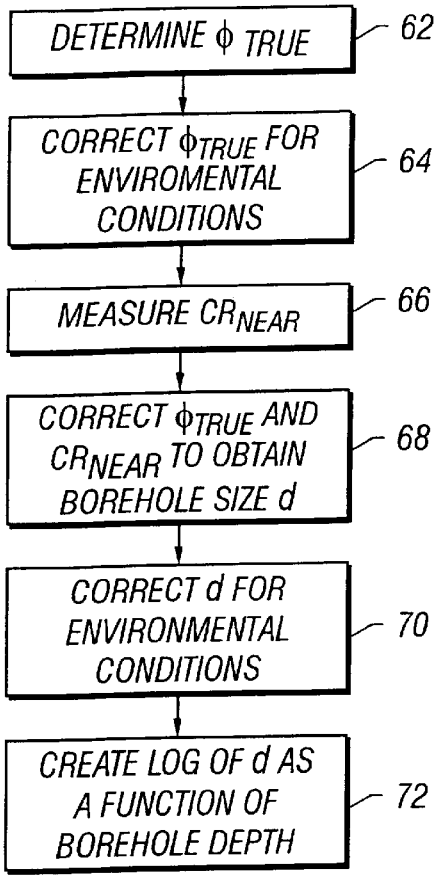
FIG. 2 is a flow chart illustrating steps in combining detector count rate, true formation porosity, and environmental corrections to obtain a borehole caliper measurement.

FIG. 2 is a flow chart illustrating steps in combining detector count rate $CR_{near}$, true formation porosity $Ø_{true}$, and environmental corrections to obtain a borehole caliper measurement denoted as d.

Referring to FIG. 2, $Ø_{true}$, is determined at step 62, preferably using a dual detector neutron system as described above. $Ø_{true}$ is then corrected for any environmental conditions at step 64. If the dual detector thermal neutron porosity technique is used, measured porosity must be corrected for drilling fluid weight (HI), drilling fluid salinity, formation fluid salinity, formation temperature, formation pressure and the like. These corrections are known in the art, are described or referenced in the previously referenced U.S Patents, and involve the measurement or mathematical modeling of tool response in known formation and borehole conditions to obtain the desired environmental corrections. Count rate from the near detector is measured at step 66. The detector is preferably a thermal (or epi-thermal) neutron detector, and is also preferably the near detector of a dual detector thermal neutron porosity system as described previously yielding the count rate $CR_{near}$. The parameters $Ø_{true}$ and $CR_{near}$ are combined at step 68 using previously described relationships to obtain a measure of borehole size d. Borehole size d is then corrected at step 70 for environmental conditions such as drilling fluid weight (HI), drilling fluid salinity, formation fluid salinity, formation temperature, formation pressure and the like. As in the environmental corrections of $Ø_{true}$, measurements or mathematical modeling of tool response in known formation and borehole conditions are used to obtain environmental corrections for d. Alternately, $CR_{near}$ can be corrected (not shown) for environmental conditions prior to the step 68 thereby eliminating the correction of d at the step 70. Borehole caliper d is measured at step 72 as a function of position or depth of the tool 22 within the borehole 26 thereby yielding a borehole caliper log.

4. RESULTS

Figure 3A:
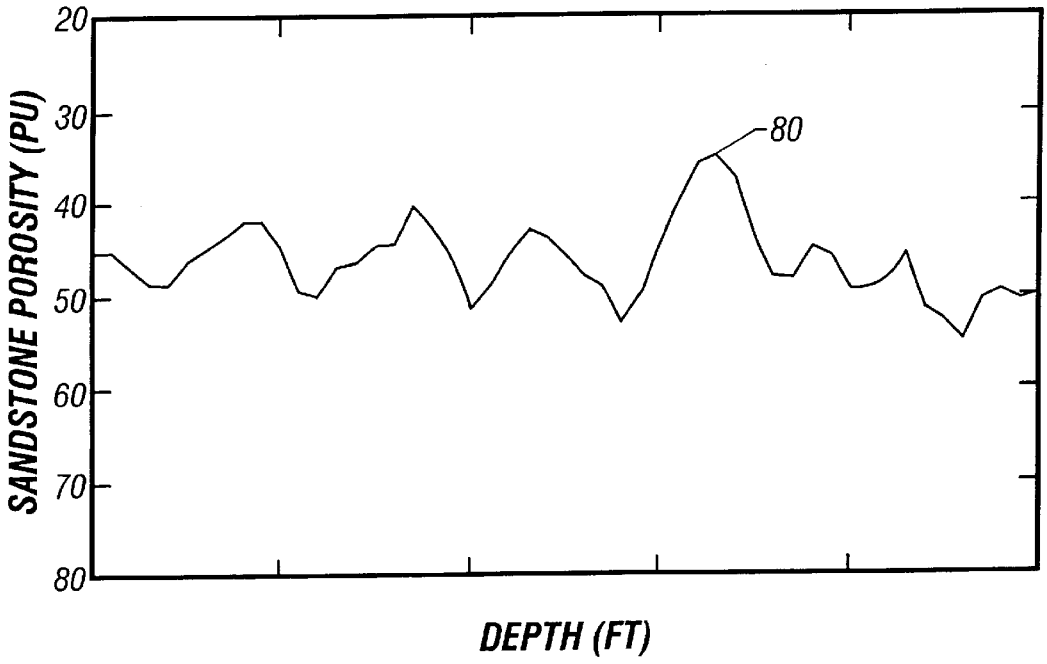
FIG. 3*a*, is a log of true formation neutron porosity computed from the dual detector tool response after correcting for environmental factors.
Figure 3B:
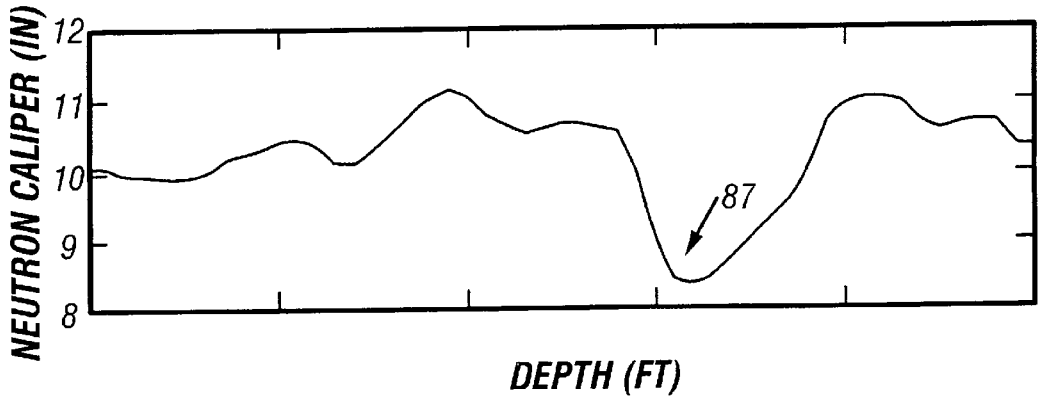
FIG. 3*b* is a corresponding caliper log obtained by combining "true" formation porosity of the environmentally corrected dual detector neutron porosity system and count rate from the near detector, and correcting for environmental factors.

FIGS. 3*a* and 3*b* show results of the disclosed invention in a well borehole drilled with a nominal drill bit size of 8.5 inches in diameter. FIG. 3*a* shows a log of formation porosity as a function of depth obtained from the dual detector neutron porosity system shown in FIG. 1. Curve 80 represents $Ø_{true}$ corrected for environmental conditions.

FIG. 3*b* is a corresponding caliper log d as a function of depth obtained by combining $Ø_{true}$ and count rate $CR_{near}$ from the near detector, and corrected for environmental factors, as disclosed previously. In depth interval 87, which shows good borehole conditions, the caliper log reads a nominal 8.4 inches in diameter which is in good agreement with the bit size and indicating that the caliper system is yielding very accurate results. The caliper curve indicates significant "washout", of greater than 10 inches outside interval 87.

5. ALTERNATE EMBODIMENTS

Figure 4:
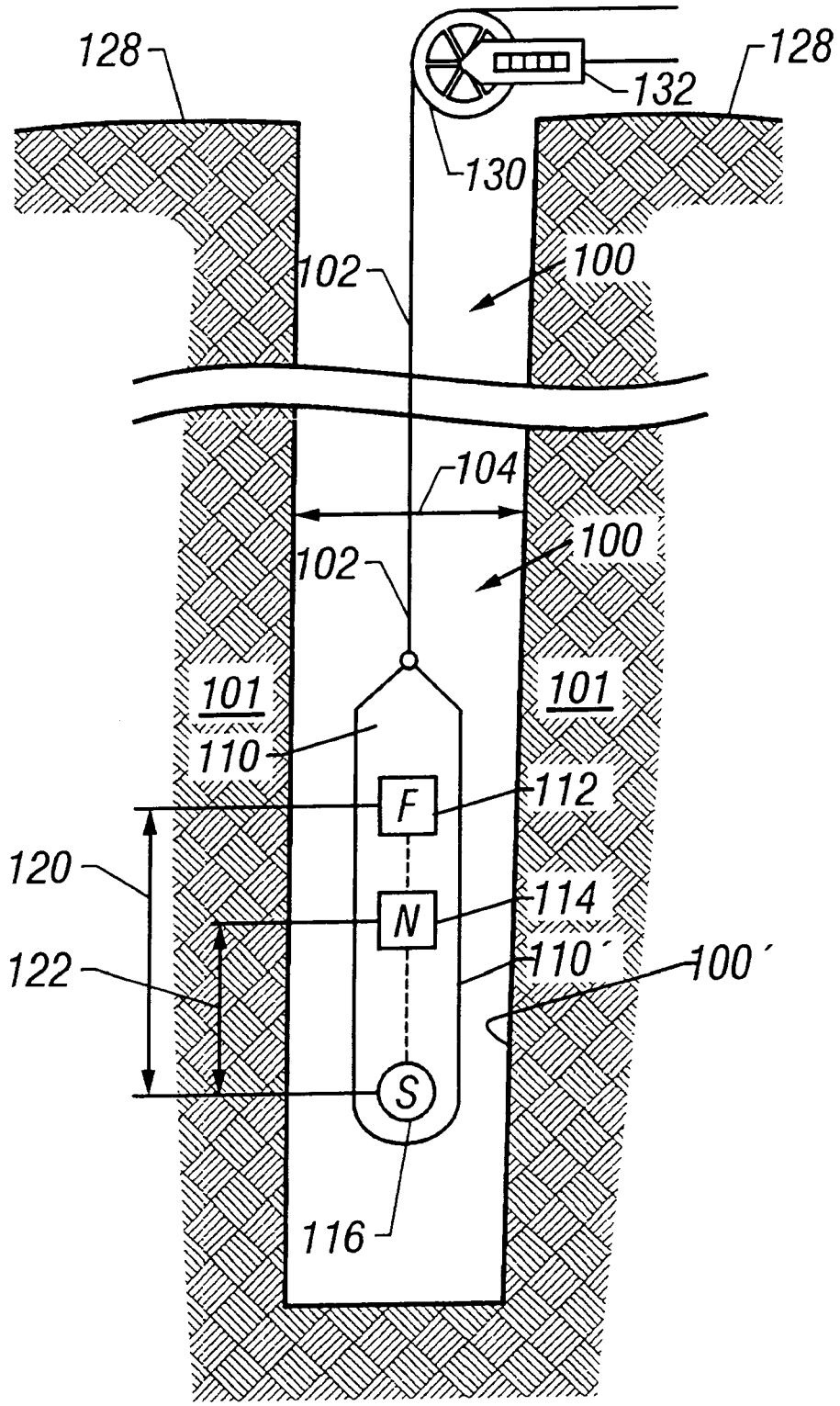
FIG. 4 is a conceptual illustration of a borehole caliper system configured as a dual detector neutron porosity system and embodied as a wireline borehole sonde.

FIG. 4 illustrates a borehole caliper system configured as a dual detector neutron porosity device embodied for wireline operations. A neutron source 116 is preferably axially aligned with a near detector 114 and a far detector 112 within a pressure tight, cylindrical instrument or sonde 110. The upper end of the sonde 110 is suspended from a sheave wheel 132 by means of a wireline 102 within a borehole 100 of diameter 104 which penetrates a formation 101. The near detector 114 is spaced a distance 122 preferably above the source 116, and the far detector 112 is spaced a distance 120 preferably above the source 116. As in the LWD embodiment of the system, the axial positions of the detectors with respect to the source can be reversed, and the near detector and the far detector can alternately be axially positioned on either side of the source, respectively. Count rate data $C_{near}$ from the near detector 114 is preferentially responsive to borehole fluid within the annulus defined by the borehole wall 100' and the known outside diameter of the tool 110'. The near detector count rate is, therefore, again preferred for use in determining borehole size d represented by the dimension 104. As is well known in the art, count rate data are transmitted to the surface of the earth 128 by means of electrical or fiber optic conductors within the wireline 102 where they are processed, and recorded and displayed as a function of depth within the borehole at which they are measured, using depth measurements supplied by the depth indication means 132. True porosity $Ø_{true}$ and $CR_{near}$ are combined, as previously discussed and illustrated conceptually in FIG. 2, to obtain a log of borehole size d as a function of depth.

Figure 5:
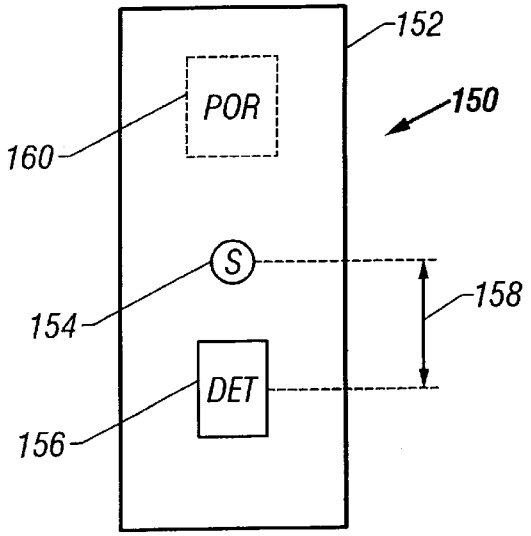
FIG. 5 is a borehole caliper tool utilizing a single detector, where the tool can be embodied in a LWD or a wireline logging system.

FIG. 5 is a second alternate embodiment of a borehole caliper tool 150 which can be conveyed as a LWD or as a wireline tool. The tool utilizing a single neutron detector 156 axially spaced a distance 158 from a neutron source 154. A measure of true neutron porosity is combined with a count rate from detector 156 to obtain borehole caliper using methodology discussed previously. As in previous embodiments, neutrons emitted by the source 154 interact with borehole fluid in the vicinity of the tool 152 to induce a count rate indicative of the volume of borehole fluid, thus borehole size, in the vicinity of the tool. Means for determining true porosity are illustrated by the broken line box 160. The means 160 can be contained within the tool 150 or conveyed with the tool. Alternately, true porosity can be obtained by means 160 completely removed from the tool 150, such as from drill core data, porosity measurements from offset wells, and the like.

The invention is directed toward measuring the size of a borehole penetrating earth formation. It should be understood, however, that the invention can also be used to be measure the size of any type of borehole penetrating any type of material if the borehole contains a hydrogenous fluid and if the porosity of the material can be determined.

While the foregoing is directed to the preferred and alternate embodiments of the invention, the scope thereof is determined by the claims which follow.

What is claimed is:

1. A method for determining the size of a borehole penetrated material, comprising:

(a) positioning a detector within said borehole;

(b measuring a response of said detector indicative of a hydrogen index of a fluid within said borehole and of a hydrogen index of said material;

(c) combining said response with a measure of porosity of said material to delineate a portion of said response attributable to said borehole; and (d) combining a known fluid hydrogen index with said portion of said response attributable to said borehole to obtain said size of said borehole.

2. The method of claim 1 wherein:

(a) said material comprises chemically bound hydrogen; and (b) said measure of porosity is a neutron porosity measurement.

3. The method of claim 1 comprising the additional step of inducing said response by irradiating said fluid and said material with neutrons.

4. The method of claim 3 wherein said neutrons are provided by a neutron source emitting a continuous flux of neutrons.

5. The method of claim 4 wherein said neutron source is an isotopic source.

6. The method of claim 4 wherein said detector and said neutron source are conveyed along said borehole on a drill string.

7. The method of claim 4 wherein said detector and said neutron source are conveyed along said borehole on a wireline.

8. The method of claim 3 wherein said response is related to a flux of thermal neutrons impinging upon said detector.

9. The method of claim 1 wherein said material is an earth formation.

10. A method for determining the size of a borehole penetrating an earth formation, comprising:

(a) positioning a neutron source within said borehole and irradiating said formation and material within said borehole with neutrons;

(b) positioning a first detector within said borehole which is axially spaced from said neutron source and is responsive to said neutron irradiation;

(c) from a response of said first detector, determining a first porosity measurement;

(d) combining said first porosity measurement with a formation neutron porosity measurement to delineate a portion of said response attributable to said borehole; and (e) combining a known fluid hydrogen index with said portion of said response attributable to said borehole to obtain said size of said borehole.

11. The method of claim 10 wherein said first porosity measurement is determined from a parameterized response function obtained by relating said first detector response to said first porosity measurements in known borehole and known formation conditions.

12. The method of claim 10 comprising the additional steps of:

(a) positioning a second detector within said borehole which is axially spaced from said neutron source at a distance different from said first detector and responsive to said neutron irradiation;

(b) combining said response of said first detector and a response of said second detector to obtain a second formation porosity measurement; and (c) correcting said second formation porosity measurement for environmental conditions to obtain said formation neutron porosity measurement.

13. The method of claim 12 wherein said first detector is axially spaced closer to said neutron source than said second detector.

14. The method of claim 12 wherein said neutron source emits a continuous flux of neutrons.

15. The method of claim 14 wherein said neutron source is an isotopic source.

16. The method of claim 12 wherein said first and second detectors respond to thermal neutrons impinging thereon.

17. The method of claim 12 comprising the additional steps of:

(a) positioning said neutron source and said first and said second detectors within a drill collar;

(b) conveying said drill collar along said borehole on a drill string, and (c) measuring said size of said borehole as a function of depth of said drill collar along said borehole.

18. The method of claim 12 comprising the additional steps of:

(a) positioning said neutron source and said first and said second detectors within a logging sonde;

(b) conveying said sonde along said borehole on a wire line, and (c) measuring said size of said borehole as a function of depth of said sonde within said borehole.

19. A system for determining the size of a borehole penetrating an earth formation, comprising:

(a) a neutron source for irradiating said formation and material within said borehole with neutrons;

(b) a first detector axially spaced from said neutron source and which is responsive to said neutron irradiation;

(c) a pressure tight structure containing said neutron source and said first detector; and (d) computation means for (i) determining a first porosity from a response of said first detector, (ii) combining said first porosity measurement with a formation neutron porosity measurement to delineate a portion of said response attributable to said borehole, and (iii) combining a known fluid hydrogen index with said portion of said response attributable to said borehole to obtain said size of said borehole.

20. The system of claim 19 further comprising a parameterized response function obtained by relating said first detector response to said first porosity measurements in known borehole and known formation conditions, wherein said response function is used to determine said first porosity measure.

21. The system of claim 20 comprising a second detector contained in said pressure tight structure and axially spaced from said neutron source at a distance different from said first detector and responsive to said neutron irradiation, wherein (a) said response of said first detector and a response of said second detector are combined to obtain a second formation porosity measurement; and (b) said second formation porosity measurement is corrected for environmental conditions to obtain said formation neutron porosity measurement.

22. The system of claim 21 wherein said first detector is axially spaced closer to said neutron source than said second detector.

23. The system of claim 21 wherein said first and second detectors are thermal neutron detectors.

24. The system of claim 19 wherein said neutron source emits a continuous flux of neutrons.

25. The system of claim 24 wherein said neutron source is an isotopic source.

26. The system of claim 19 wherein:

(a) said pressure tight structure is a drill collar; and (b) said drill collar is conveyed along said borehole on a drill string.

27. The system of claim 19 wherein:

(a) said pressure tight structure a logging sonde; and (b) said sonde is conveying along said borehole on a wireline.

* * * * *